United States Patent [19]

Musgrave

[11] Patent Number: 4,597,213

[45] Date of Patent: Jul. 1, 1986

[54] MAGAZINE CARRIER FOR USE ON FIREARMS OR OTHER SUPPORT

[76] Inventor: Daniel D. Musgrave, 8201 Caraway St., Cabin John, Md. 20818

[21] Appl. No.: 682,944

[22] Filed: Dec. 18, 1984

[51] Int. Cl.[4] ..... F41C 27/00

[52] U.S. Cl. ..... 42/90

[58] Field of Search ..... 42/90, 87, 88, 89; 224/239; 221/151, 282, 289–293

[56] References Cited

U.S. PATENT DOCUMENTS

| | | | |
|---|---|---|---|
| 2,396,184 | 3/1946 | Lima | 42/89 |
| 4,100,694 | 7/1978 | Musgrave | 42/90 |
| 4,115,943 | 9/1978 | Musgrave | 42/90 |
| 4,120,109 | 10/1978 | Musgrave | 42/90 |
| 4,272,903 | 6/1981 | Griffis | 42/89 |
| 4,442,962 | 4/1984 | Musgrave | 42/90 |

*Primary Examiner*—Charles T. Jordan

[57] ABSTRACT

A magazine carrier for attachment to a firearm or other support. The carrier holds a magazine securely, yet permits it to be removed easily and quickly when needed. Only one hand is required for removal, and the hand grasps the magazine in a correct orientation for insertion into a firearm. The magazine can also be removed from the carrier by a hand wearing a glove.

18 Claims, 6 Drawing Figures

MAGAZINE CARRIER FOR USE ON FIREARMS OR OTHER SUPPORT

Many firearms use detachable magazines which can be quickly removed when empty, to be replaced by full magazines. The additional magazines are usually carried in a pouch on the person of the user. In situations where the utmost firepower is needed there is necessarily a significant delay while a magazine is removed from the pouch, properly oriented, and inserted into its receptacle on the firearm.

The time required to remove the empty magazine is also significant, but some firearms are so constructed that this can be accomplished without releasing the grip of the firing hand, by pressing a release with a finger. This arrangement permits the other hand to be simultaneously reaching for a full magazine. It is readily apparent that if the full magazine is placed in a convenient location and is properly oriented, it can be quickly grasped and inserted into its receptacle on the firearm.

In addition to expediting the exchange of magazines the present invention will allow a firearm to remain unloaded, yet ready to be loaded in an extremely short time.

It is desired to point out that the word firearm is used herein in a broad sense and that it is not intended to limit the invention to any particular class of firearms. Furthermore the invention can be employed with dummy, replica, or other non-shooting "firearms".

The principal object of this invention is to provide a magazine carrier which can hold a magazine securely.

Another object is to provide such a carrier which will permit rapid removal of a magazine therefrom.

Another object is to provide such a carrier which will be economical to fabricate.

These and other objects of the present invention will become apparent upon reference to the following specification, taken in connection with the accompanying drawings, wherein.

Figures 1, 2, 3, 4, 5, 6:
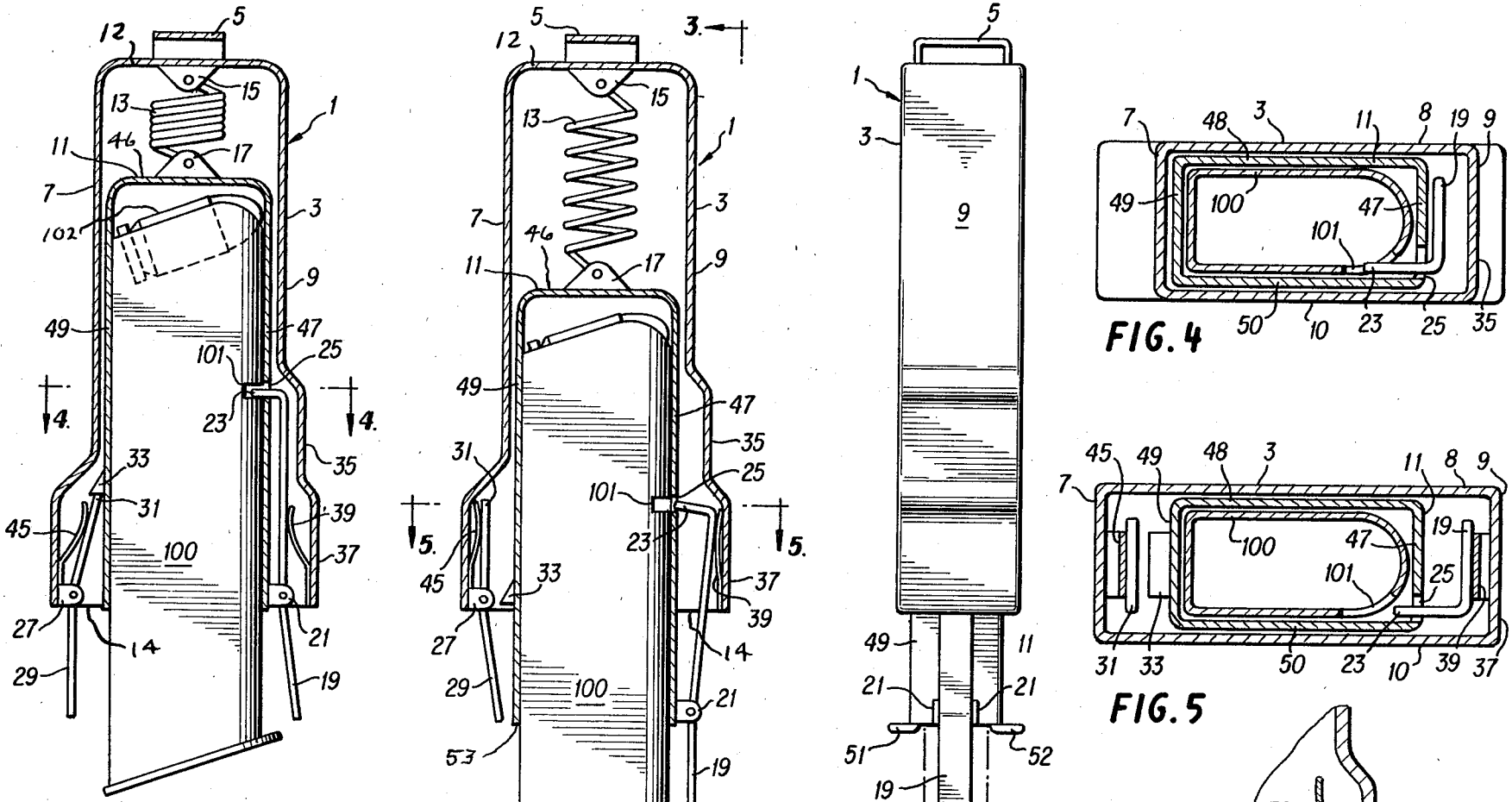
FIG. 1 is a longitudinal section of a magazine carrier with a magazine installed therein.
FIG. 2 is similar to FIG. 1, but the magazine and some of the parts are positioned differently.
FIG. 3 is a side view of the carrier shown in FIG. 2, taken in the plane indicated by arrows 3—3 on FIG. 2.
FIG. 4 is a horizontal section, taken in the plane indicated by arrows 4—4 on FIG. 1.
FIG. 5 is a horizontal section, taken in the plane indicated by arrows 5—5 on FIG. 2.
FIG. 6 is a detail view of a portion of the carrier at the extreme right of FIG. 1.

The drawings have been prepared for the purpose of disclosing the invention and they do not show any particular magazine. In actual practice the invention can be applied to carriers for magazines differing in configuration from that used as an example. The carrier shown is merely exemplary. The drawings should not be construed as limitations on the invention.

Referring to the drawings in detail, FIG. 1 shows a magazine carrier 1, having a housing 3 made of any suitable material such as a metal or a plastic. At the top of the housing is loop 5, by which the housing may be attached to a supporting structure, which might be a firearm, a vehicle, or the clothing or equipment of a user. Other types of attachment devices can be used instead of the loop, if desired.

Referring to FIGS. 1 and 4 it will be noted that the housing has five sides 7, 8, 9, 10, and 12. It also has an open end 14 into which is inserted magazine engagement means 11 which also has five sides 46, 47, 48, 49, and 50, and an open end 53 into which a magazine can be inserted. The said five sides form a casing, and that word, as used in this specification, is intended to mean the magazine engagement means of the embodiment disclosed herein.

The interior of the casing is dimensioned and shaped to encompass a magazine, which is slideable therein, snugly, but not tightly. It is not essential however, that the magazine be engaged within a complete casing; an open frame can be used as an alternate. The magazine engagement means can be made of any suitable material, such as a metal or a plastic. It must be a close fit within the housing, but loose enough to slide therein.

The casing is pulled upward within the housing by extension spring 13, which is connected to lug 15 on the housing and lug 17 on the casing. FIG. 1 shows the casing at its uppermost position in the housing. In addition to the pull of the spring it is retained at the uppermost position by latch 29 which is pivotably mounted on the housing by a pair of lugs 27. Only one of these lugs is visible in the drawing.

The latch is urged against the casing by a spring 45 mounted, by any suitable means, on the housing. The end 31 of the latch can contact abutment 33 on the casing and thus prevent downward movement.

A second latch is provided to retain the magazine within the casing. It comprises a lever 19 which is pivotably mounted on the casing by a pair of lugs 21. At the upper end of the lever is a claw 23 which is shaped and positioned so as to be able to pass through a hole 25 in the casing. The upper portion of the lever is urged toward the casing by a spring 39, mounted on the housing by any suitable means.

FIG. 6 shows spring 39 mounted on the housing by rivets 41 and 43. The same method could be used to mount spring 45.

It should be noted that the carrier can be made without a latch for the casing. But in such an arrangement the tension exerted by spring 13 would need to be greatly increased, to prevent unintentional movement of the casing.

Operation of the carrier will be described by starting with FIG. 1. The casing is in the uppermost position, held there by latch 29 and spring 13. Within the casing is a magazine 100, having a slot 101 formed in its side wall in a well-known manner. When the magazine is inserted into a firearm this slot cooperates with a latch on the firearm to keep the magazine properly inserted.

In FIG. 1, claw 23 has passed through hole 25 in the casing and has entered slot 101. The magazine is thus mechanically retained in the casing.

The magazine has a top-most cartridge 102 visible in FIGS. 1 and 2. It is desired to emphasize that the present invention can be employed with magazines differing in configuration from that shown.

When the carrier is in the condition shown in FIG. 1, latch 19 cannot be moved a sufficient distance to move claw 23 out of slot 101. This is because the wall of the housing at 35 is shaped and dimensioned to block the latch and limit the angle through which it can pivot. It should be understood that the clearance between the latch and the wall at 35 is exagerated on the drawing, for clarity.

The carrier being attached to a supporting structure by loop 5, and the magazine being installed as in FIG. 1, removal is accomplished as follows.

The user grasps the lower portion of the magazine and latches 19 and 29 with his hand and pulls downward. Latch 29 is thereby released but latch 19 is blocked by the wall of the housing at 35.

Claw 23 pulls the casing and the magazine downward. During this movement the user's hand slides down along latch 29.

When the parts reach the position shown in FIG. 2, latch 19 is no longer blocked, because the wall of the housing at 37 is shaped and dimensioned to permit the latch to move a sufficient distance to withdraw claw 23 from slot 101. The latch pivots and withdraws the claw.

As the user's hand continues downward it pulls the magazine out of the casing while sliding down along latch 19.

The removal can be accomplished in one continuous motion, and the magazine is then ready for insertion into a firearm.

Projections 51 and 52 are provided so that the casing can be pulled down when a magazine is to be inserted into the carrier.

What I claim is:

1. A carrier for a cartridge magazine, said carrier comprising: a housing; means for attaching said housing to a supporting structure; magazine engagement means slideable within said housing; releaseable latch means on said magazine engagement means, said latch means positionally adapted for retaining said magazine within said magazine engagement means; and bias means urging said magazine engagement means toward a first position within said housing whereat blocking means prevents release of said latch means.

2. A carrier as set forth in claim 1 wherein said housing comprises five contiguous sides and one open end.

3. A carrier as set forth in claim 1 wherein said means for attaching said housing to a supporting structure comprises a loop affixed to said housing.

4. A carrier as set forth in claim 1 wherein said magazine engagement means comprises a casing having five contiguous sides and one open end.

5. A carrier as set forth in claim 4 wherein said casing is configured to closely encompass a portion of said magazine.

6. A carrier as set forth in claim 4 wherein said latch means comprises a lever pivotable on said casing, said lever having an end adapted to contact a surface on said magazine.

7. A carrier as set forth in claim 6 wherein said surface is an edge of a slot in said magazine.

8. A carrier as set forth in claim 6 wherein said lever is biased in a predetermined direction relative to said magazine, when said magazine is positioned within said casing.

9. A carrier as set forth in claim 1 wherein said blocking means comprises a portion of a wall of said housing.

10. A carrier as set forth in claim 1 wherein said bias means comprises an extension spring, one end of said spring connected to said housing and another end of said spring connected to said magazine engagement means.

11. A carrier as set forth in claim 1 which includes releaseable detent means positionally adapted for preventing movement of said magazine engagement means away from said first position.

12. A carrier as set forth in claim 11 wherein said detent means is biased in a predetermined direction relative to said magazine engagement means.

13. A carrier as set forth in claim 1 wherein said magazine engagement means is moveable to a second position within said housing whereat said latch means can be released.

14. A carrier as set forth in claim 13 wherein said magazine engagement means is provided with projecting surfaces for grasping to permit said magazine engagement means to be moved from said first to said second position.

15. A carrier as set forth in claim 4 wherein said casing serves as a cover for a feed end of a magazine.

16. A carrier for a cartridge magazine, said carrier comprising: a housing; means for attaching said housing to a supporting structure; a casing moveable within said housing, said casing capable of closely encompassing a portion of said magazine; releaseable latch means on said casing, said latch means positionally adapted for retaining said magazine in said casing; bias means in said housing urging said casing toward a first position within said housing whereat blocking means prevents release of said latch means from said magazine; said casing also moveable to a second position within said housing whereat said latch means can be released from said magazine.

17. A carrier as set forth in claim 16 further provided with releaseable detent means positionally adapted for preventing movement of said casing from said first to said second position within said housing.

18. A carrier as set forth in claim 17 wherein said detent means is biased in a predetermined direction relative to said casing.

* * * * *